US009147973B1

(12) United States Patent
Madison

(10) Patent No.: US 9,147,973 B1
(45) Date of Patent: Sep. 29, 2015

(54) ENCLOSURE FOR WALL CHARGER

(71) Applicant: Michael W. Madison, Gulf Shores, AL (US)

(72) Inventor: Michael W. Madison, Gulf Shores, AL (US)

( * ) Notice: Subject to any disclaimer, the term of this patent is extended or adjusted under 35 U.S.C. 154(b) by 135 days.

(21) Appl. No.: 14/023,645

(22) Filed: Sep. 11, 2013

(51) Int. Cl.
*H01R 13/62* (2006.01)
*H01R 13/639* (2006.01)

(52) U.S. Cl.
CPC ..... *H01R 13/6395* (2013.01); *H01R 13/6397* (2013.01)

(58) Field of Classification Search
CPC ..... H01R 13/6395; H01R 13/6397; H01R 13/447
USPC ..... 439/367–373
See application file for complete search history.

(56) References Cited

U.S. PATENT DOCUMENTS

| | | | | | |
|---|---|---|---|---|---|
| 3,159,446 | A | * | 12/1964 | Protzmann | 439/304 |
| 3,775,729 | A | * | 11/1973 | Casper | 439/459 |
| 3,811,104 | A | * | 5/1974 | Caldwell | 439/135 |
| 4,105,274 | A | * | 8/1978 | Casey | 439/368 |
| 4,895,527 | A | * | 1/1990 | Brown et al. | 439/147 |
| 4,895,999 | A | * | 1/1990 | Calderon | 174/67 |
| 5,539,821 | A | | 7/1996 | Blonder | |
| D527,728 | S | | 9/2006 | Sbordon, Jr. | |
| D549,171 | S | | 8/2007 | Sbordon, Jr. | |
| 7,528,323 | B2 | | 5/2009 | Wu et al. | |
| 8,378,625 | B2 | | 2/2013 | Gourley | |
| 2003/0137276 | A1 | | 7/2003 | Lin | |
| 2008/0272258 | A1 | | 11/2008 | Wysoczynski | |
| 2009/0047827 | A1 | | 2/2009 | Liao | |

FOREIGN PATENT DOCUMENTS

| | | |
|---|---|---|
| GB | 2467572 | 8/2010 |
| WO | WO2008/155644 | 12/2008 |
| WO | WO2013/098078 | 7/2013 |

* cited by examiner

*Primary Examiner* — Khiem Nguyen
(74) *Attorney, Agent, or Firm* — George L Williamson

(57) ABSTRACT

Method and apparatus for securing a cell phone charger to a standard AC electrical wall power outlet while the charger is plugged into the wall outlet for being charged. The enclosure may be cube shaped having air holes being opened on its front for placing the charger therein. There is a tab thereon for securing the enclosure by means of a fastener to the AC power outlet and an aperture on the rear so that the connecting cord to the charger can be passed therethrough. Additionally shown on the upper portion of the rear wall of the enclosure is another tab having a hole therein for receiving a conventional zip tie to allow the connecting cord from the charger to be secured to the tab of the enclosure.

16 Claims, 3 Drawing Sheets

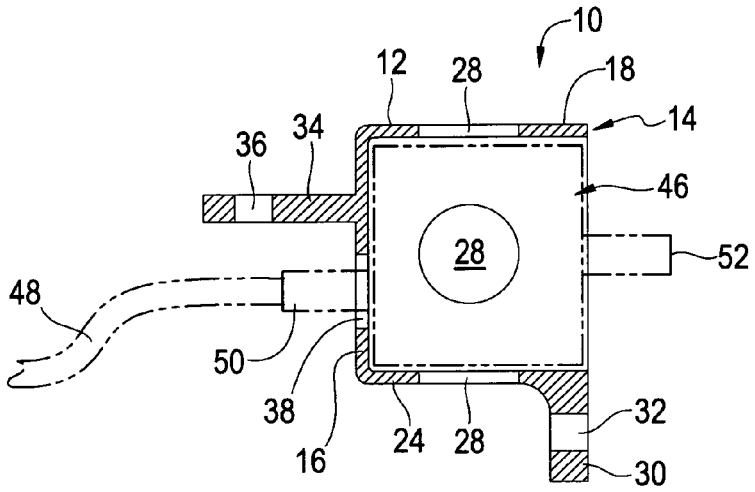
FIG. 3
FIG. 4
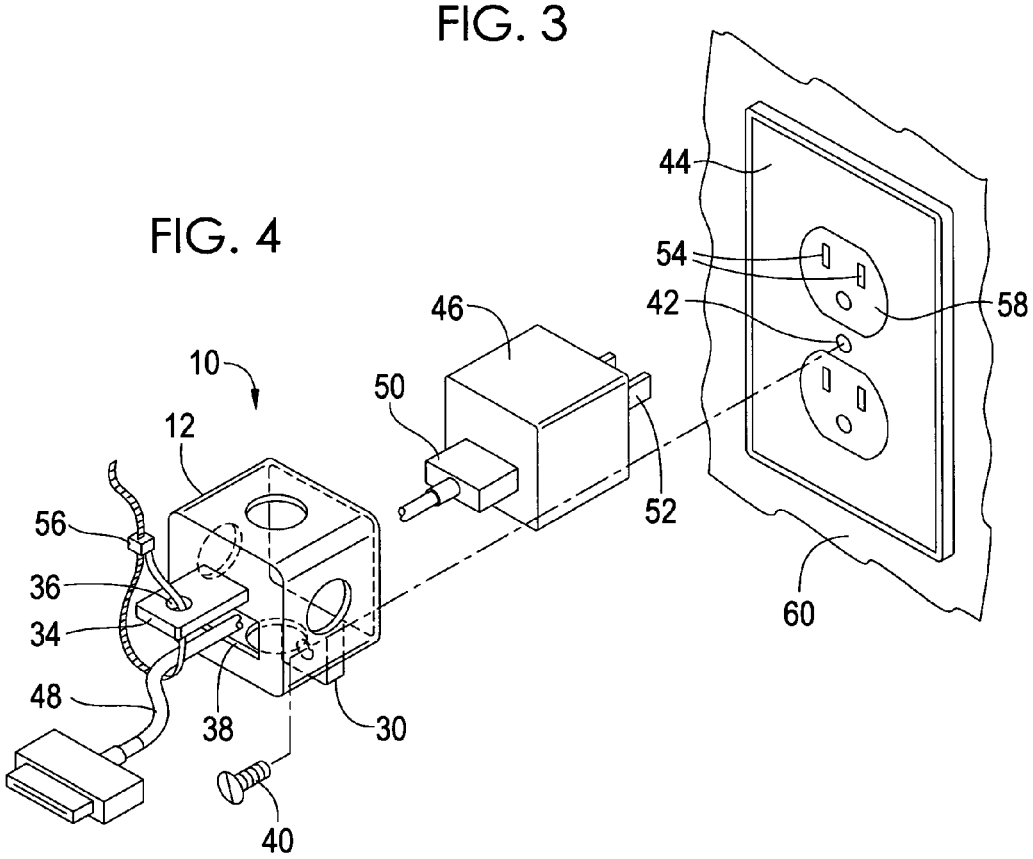

ENCLOSURE FOR WALL CHARGER

BACKGROUND OF THE INVENTION

1. Field of the Invention

The present invention relates generally to electronic devices and, more particularly, is concerned with an enclosure for securing a wall charger to an electrical wall outlet.

2. Description of the Related Art

Devices relevant to the present invention have been described in the related art, however, none of the related art devices disclose the unique features of the present invention.

In U.S. Pat. No. 7,528,323 dated May 5, 2009, Wu, et al., disclosed a power supply cover box. In U.S. Patent Application Publication 2009/0047827 dated Feb. 19, 2009, Liao disclosed a socket assembly. In U.S. Patent Application Publication 2003/0137276 dated Jul. 24, 2003, Lin disclosed a travel charger for cellular telephones. In U.S. Patent Application Publication 2008/0272258 dated Nov. 6, 2008, Wysoczynski disclosed a device for a rechargeable electrical apparatus retainer unit. In U.S. Pat. No. 5,539,821 dated Jul. 23, 1996, Blonder disclosed a power outlet mount for a portable telephone. In U.S. Pat. No. 8,378,625 dated Feb. 19, 2013, Gourley disclosed a mobile electronic device AC charger mount. In U.S. Design Pat. D527,728 dated Sep. 5, 2006, Sbordon, Jr. disclosed a cell phone charging station. In U.S. Design Pat. D549,171 dated Aug. 21, 2007, Sbordon, Jr., disclosed a cell phone charging station. In U.K. Patent Application Publication GB 2467572 dated Aug. 11, 2010, Lee disclosed a mobile phone charger with shelf. In WIPO Publication No. WO 2008/155644 dated Dec. 24, 2008, Amiram disclosed a cell phone holder for wall charger. In WIPO Publication No. WO2013/098078 dated Jul. 4, 2013 Schneider disclosed an installation arrangement. While these devices may be suitable for the purposes for which they were designed, they would not be as suitable for the purposes of the present invention as hereinafter described.

SUMMARY OF THE PRESENT INVENTION

The present invention discloses an enclosure for securing a battery charger unit, e.g., a cell phone charger, for a standard AC electrical wall power outlet while the charger is plugged into the wall outlet for being charged. The enclosure may be cube shaped having air holes on all sides and being open on its front in order to access the internal cavity for placing the charger therein so that the charger and its front is proximate the electrical wall outlet. On the rear wall of the enclosure is an aperture so that the connecting cord to the charger can be passed therethrough. Also shown on the lower portion of the front is a downwardly extending tab having a hole therein through which hole a fastener e.g., a screw, is inserted for securing the tab and enclosure to the conventional electrical wall outlet. Additionally shown on the upper portion of the rear wall of the enclosure is another tab having a hole therein for receiving a conventional cable tie or zip tie therethrough to allow the connecting cord from the charger to be secured to the tab of the enclosure using a cable tie.

An object of the present invention is to secure a small cell phone charger to a conventional AC electrical wall outlet. A further object of the present invention is to provide a means for protecting the electrical charger from being stolen while the charger is placed in the conventional wall outlet. A further object of the present invention is to provide a security device which can be easily used by the user of the charger. A further object of the present invention is to provide an enclosure for securing a charger to a conventional AC wall outlet which can be easily and relatively inexpensively manufactured.

The foregoing and other objects and advantages will appear from the description to follow. In the description reference is made to the accompanying drawings, which fonn a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 3 is a cross sectional side view of the present invention containing a charger.

FIG. 4 is an exploded perspective view of the present invention shown in operative connection.

LIST OF REFERENCE NUMERALS

Figure 1:
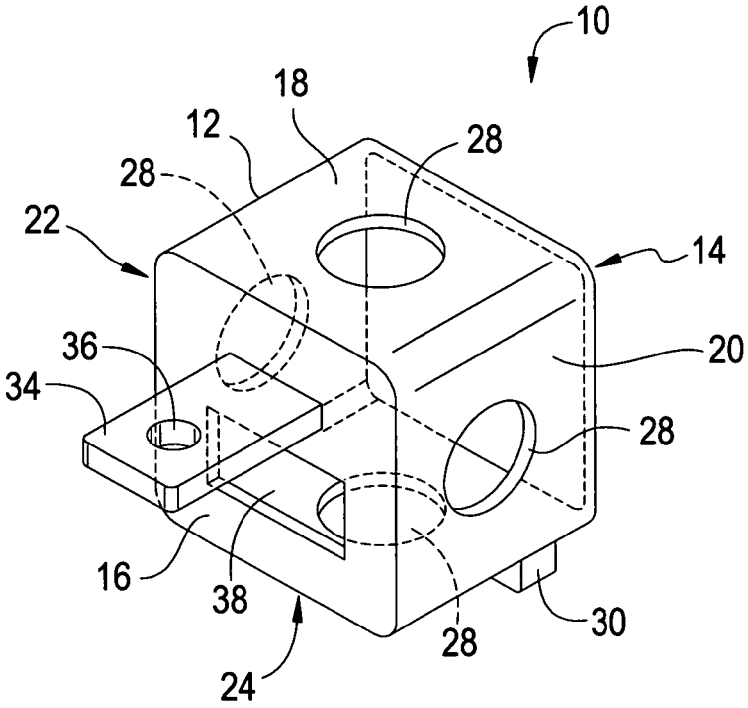
FIG. 1 is a perspective view taken from the rear of the present invention.

With regard to reference numerals used, the following numbering is used throughout the drawings.

10 present invention
12 enclosure
14 front portion
16 rear wall portion
18 top wall portion
20 first side wall portion
22 second side wall portion
24 bottom side wall portion
26 internal cavity
28 air hole
30 first tab
32 aperture of first tab
34 second tab
36 aperture of second tab
38 enlarged aperture
40 screw/fastener
42 screw hole
44 cover plate
46 charger
48 connecting wire/cord
50 plug portion
52 electrical prongs
54 receptacle holes
56 cable tiezip tie
58 wall outlet
60 wall
62 rectangular shaped enclosure
64 round shaped enclosure
66 elliptical shaped enclosure
68 trapezoidal shaped enclosure

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 4 illustrate the present invention wherein an enclosure for securing a phone charger to a conventional electrical wall outlet is disclosed and which is generally indicated by reference number 10.

Figure 2:
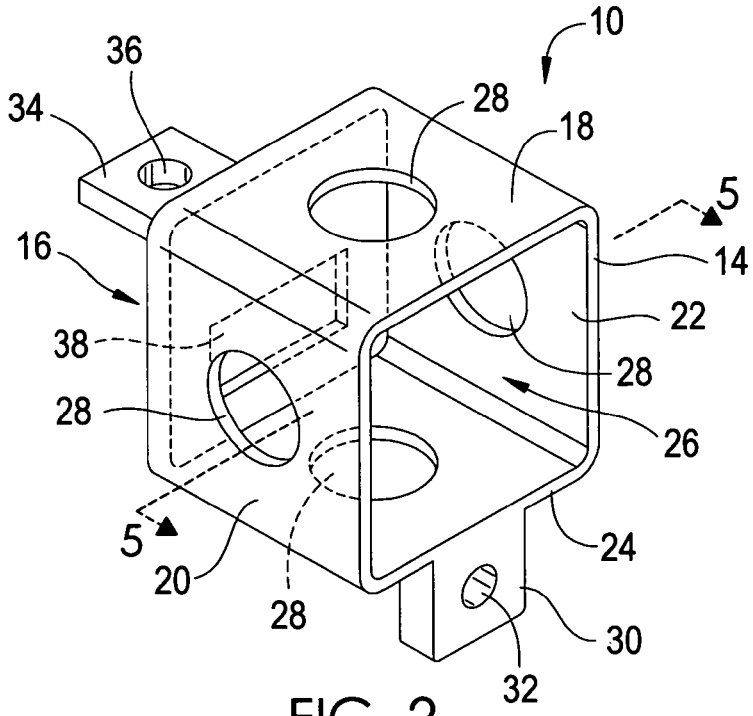
FIG. 2 is a perspective view taken from the front of the present invention.

The following written description makes reference generally to all the FIGS. 1-4 and may reference specific Figures which will be indicated in the written description. Turning to FIGS. 1 and 2, therein is shown the present invention 10 being an enclosure 12 being, for illustration purposes only, generally shaped like a cube having a front side portion 14, a rear side portion 16, a top side portion 18, a first side portion 20, a second side portion 22, and a bottom side portion 24. The front side 14 of the enclosure is open as shown at 26 providing an internal cavity on the inside of the enclosure 12. The sides 18, 20, 22, 24 each have an air hole 28 therein for providing cooling to the charger which would be contained inside the enclosure 12. On the bottom side 24 near the front of the enclosure 12 is a downwardly extending tab 30 having an aperture 32 therein for receiving a screw 40 therethrough so that the screw/fastener 40, having threads mating to the screw receiving hole 42 on the wall outlet 58, can be screwed into the mating screw receiving hole 42 for securing the enclosure 12 to the conventional AC wall outlet 58. Also shown on the rear wall 16 of the enclosure 12 near the upper portion of the rear wall is another tab 34 having another aperture 36 therein. Also shown on the rear wall 16 of enclosure 12 is a larger aperture 38 effectively sized so that a connecting wire/cord 48 and plug 50, if necessary, from the charger 46 can be passed therethrough. Aperture 38 is expected to be larger than apertures 32, 36. The enclosure 12 could be of any size and shape suitable for receiving a charger 46 therein so long as the enclosure is effectively and/or complementarily sized and formed/shaped as the charger, and, could be made of many materials, but plastic, or the like, is the expected material of construction. Possible shapes of the enclosure 12 may include, but not be limited to, cubed, rectangular, round, conical, parabolic, elliptical and trapezoidal.

Turning to FIG. 3, therein is shown the present invention 10 along with certain previously disclosed elements wherein a charger 46 is shown being contained inside the enclosure 12 along with the connecting cord/wire 48 extending from the rear plug portion 50 of the charger. Also shown are the electrical prongs 52 which are conventional electrical prongs for use with a conventional AC electrical wall outlet 58. The front 14 of the enclosure 12 may be contiguous or proximate to the face of the cover 44 of the wall outlet 58 so as to secure the charger 46 close to the wall outlet.

Turning to FIG. 4, therein is shown the present invention 10 along with certain previously disclosed elements wherein the charger 46 is in proximity to the conventional AC wall outlet 58 mounted on the wall 60 wherein the electrical prongs 52 of the charger are shown proximate the mating receptacle holes 54 of the wall outlet 58 and cover plate 44 of the wall outlet. Also shown therein is a cable tie or zip tie 56 shown passing through the aperture 36 on the rear of the enclosure 12 and encircling the wire 48 so that the connecting wire 48 can be secured to the enclosure 12 by tightening the zip tie 56 in the standard manner as would be done by one skilled in the art.

In summary, the present invention 10 may be described as an apparatus for securing a cell phone charger 46 to a conventional electrical wall outlet 58 when the cell phone charger is connected to the conventional electrical wall outlet, having an enclosure 12 having a front portion 14 and an internal space 26; the enclosure being complementarily shaped as the cell phone charger so that the cell phone charger can be contained in the internal space; a first tab 30 disposed on the front portion of the enclosure, the first tab having a first aperture 32 therein to permit a fastener 40 to pass therethrough; and, wherein the fastener is capable of extending through the first aperture into a mating threaded hole 42 on the conventional electrical wall outlet to secure the enclosure to the conventional electrical wall outlet. Also, the enclosure having a rear portion 16 having an enlarged second aperture 38 therein to permit a connecting wire 48, 50 of the cell phone charger to pass therethrough. Also, having a second tab 34 disposed on the rear portion of the enclosure, the second tab having a third aperture 36 therein to permit a cable tie 56 to pass therethrough for securing the connecting wire to the second tab. Also, the enclosure further having at least one side wall portion 18, 20, 22, or 24 having an air hole 28 therein to permit the cell phone charger to be cooled.

Figure 5:
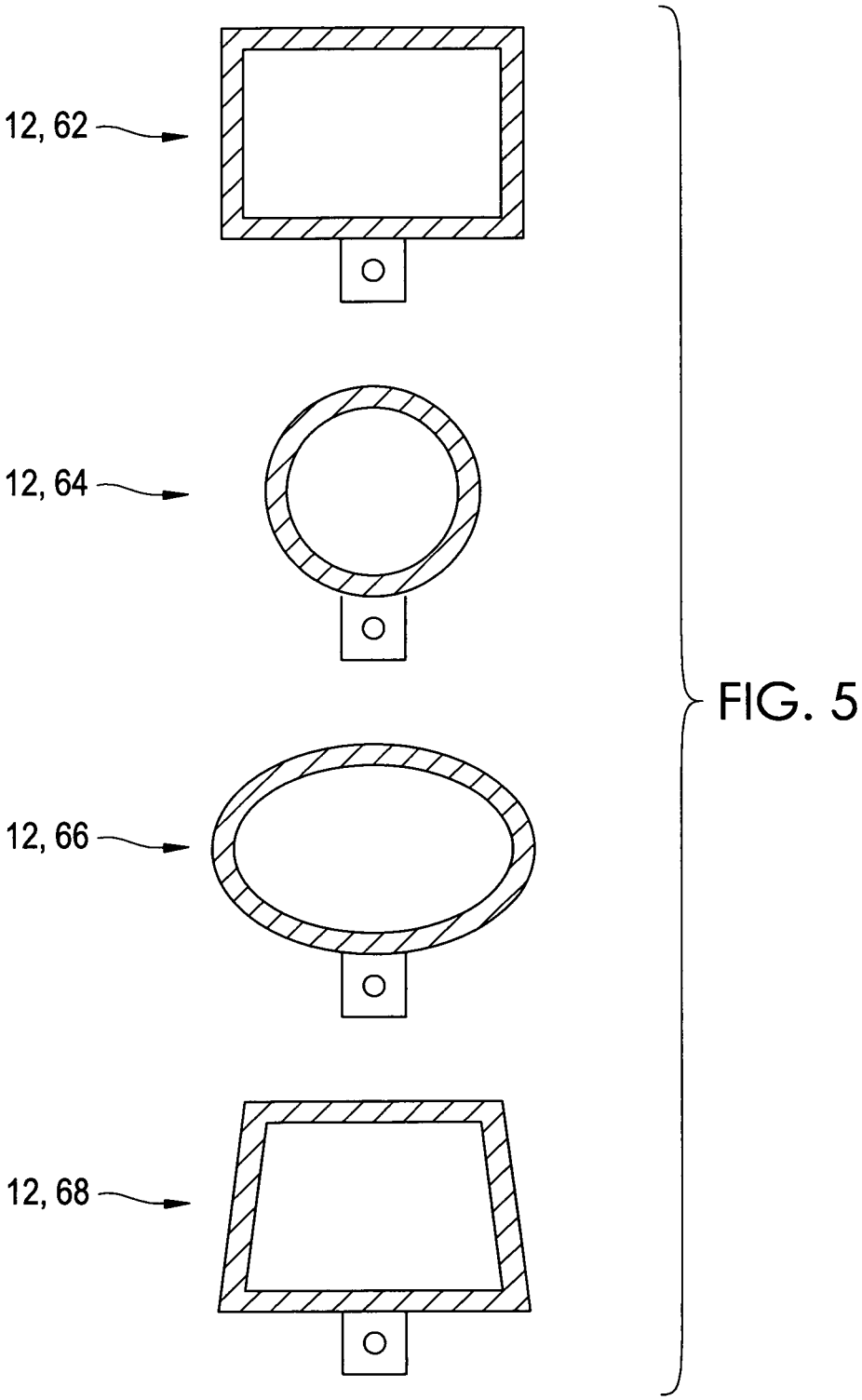
FIG. 5 shows cross sectional views of the enclosure of the present invention taken from FIG. 2 as indicated.

Turning to FIG. 5, therein are shown various shapes of the enclosure 12 of the present invention 10 including rectangular 62, round 64, elliptical 66 and trapezoidal 68. The enclosure 12 having a round 64 shape also represents a conical and parabolic shape.

I claim:

1. An apparatus for securing a cell phone charger to a conventional electrical wall outlet when the cell phone charger is connected to the conventional electrical wall outlet, comprising:

a) an enclosure, said enclosure having a front portion, said enclosure having an internal space;

b) said enclosure being complementarily shaped as the cell phone charger so that the cell phone charger can be contained in said internal space;

c) a first tab disposed on said front portion of said enclosure, said tab having a first aperture therein to permit a fastener to pass therethrough;

d) wherein said fastener is capable of extending through said first aperture into a mating threaded hole on the conventional electrical wall outlet to secure said enclosure to the conventional electrical wall outlet;

e) said enclosure having a rear portion, wherein said rear portion of said enclosure has an enlarged second aperture therein to permit a connecting wire of the cell phone charger to pass therethrough; and, f) second tab disposed on said rear portion of said enclosure, said second tab having a third aperture therein to permit a cable tie to pass therethrough for securing said connecting wire to said second tab.

2. The apparatus of claim 1, further comprising said enclosure further having at least one side wall portion having an air hole therein to permit the cell phone charger to be cooled.

3. The apparatus of claim 1, wherein said enclosure has a substantially cubed shape.

4. The apparatus of claim 1, wherein said enclosure has a substantially rectangular shape.

5. The apparatus of claim 1, wherein said enclosure has a substantially round shape.

6. The apparatus of claim 1, wherein said enclosure has a substantially elliptical shape.

7. The apparatus of claim 1, wherein said enclosure has a substantially trapezoidal shape.

8. A method for securing a cell phone charger to a conventional electrical wall outlet when the cell phone charger is connected to the conventional electrical wall outlet, comprising the steps of:

a) providing an enclosure having a front portion and an internal space;

b) providing the enclosure being complementarily shaped as the cell phone charger so that the cell phone charger can be contained in the internal space;

c) providing a first tab disposed on the front portion of the enclosure, the tab having a first aperture therein through which first aperture a fastener is capable of being extended;

d) wherein the fastener is capable of being extended through the first aperture into a mating threaded hole on the conventional electrical wall outlet for securing the enclosure to the conventional electrical wall outlet;

e) providing a rear portion on the enclosure, wherein the rear portion of the enclosure having an enlarged second aperture therein through which second aperture a connecting wire of the cell hone charger is capable of being passed;

f) providing a second tab on the rear portion of the enclosure, the second tab having a third aperture therein, the third aperture being capable of having a cable tie pass therethrough for securing the connecting wire to the second tab.

9. The method of claim 8, further comprising the step of cooling the enclosure by providing an air hole on at least one side wall portion.

10. The method of claim 8, providing the enclosure having a substantially cubed shape.

11. The method of claim 8, providing the enclosure having a substantially rectangular shape.

12. The method of claim 8, providing the enclosure having a substantially round shape.

13. The method of claim 8, providing the enclosure having a substantially elliptical shape.

14. The method of claim 8, providing the enclosure having a substantially trapezoidal shape.

15. The method of claim 8, providing the enclosure having a substantially conical shape.

16. The method of claim 8, providing the enclosure having a substantially parabolic shape.

* * * * *